US006802326B2

(12) United States Patent
Kusama

(10) Patent No.: US 6,802,326 B2
(45) Date of Patent: Oct. 12, 2004

(54) CRUTCH WITH HEIGHT-ADJUSTABLE GRIP

(75) Inventor: Yukiko Kusama, Matsumoto (JP)

(73) Assignee: Fuji Pharmaceuticals Ltd., Nagano-ken (JP)

( * ) Notice: Subject to any disclaimer, the term of this patent is extended or adjusted under 35 U.S.C. 154(b) by 75 days.

(21) Appl. No.: 10/135,774

(22) Filed: May 1, 2002

(65) Prior Publication Data

US 2002/0166579 A1 Nov. 14, 2002

(30) Foreign Application Priority Data

May 14, 2001 (JP) ..... 2001-142519

(51) Int. Cl.[7] ..... A61H 3/02
(52) U.S. Cl. ..... 135/69; 135/68; 135/73
(58) Field of Search ..... 135/68, 73, 65, 135/69, 70, 75, 76

(56) References Cited

U.S. PATENT DOCUMENTS

| | | | | | |
|---|---|---|---|---|---|
| 147,491 | A | * | 2/1874 | Frantz | 135/69 |
| 313,518 | A | * | 3/1885 | Peebles | 135/69 |
| 751,942 | A | * | 2/1904 | Renno | 135/68 |
| 1,157,314 | A | * | 10/1915 | Compte et al. | 135/68 |
| 1,254,993 | A | * | 1/1918 | Desjardins | 135/69 |
| 2,554,653 | A | * | 5/1951 | Wisecarver | 135/68 |
| 3,016,060 | A | * | 1/1962 | Beattie, Sr. | 135/73 |
| 3,034,524 | A | * | 5/1962 | Klino | 135/69 |
| 3,074,420 | A | * | 1/1963 | Gottman | 135/69 |
| 3,301,268 | A | * | 1/1967 | Tryon | 135/69 |
| 3,730,198 | A | * | 5/1973 | Johnston et al. | 135/50 |
| 4,386,466 | A | * | 6/1983 | Lee | 33/515 |
| 4,476,885 | A | * | 10/1984 | Stein | 135/69 |
| 5,025,820 | A | * | 6/1991 | Gamper | 135/69 |
| 5,299,589 | A | * | 4/1994 | Zatulovsky | 135/68 |
| 5,458,145 | A | * | 10/1995 | Davis | 135/68 |
| 5,465,745 | A | * | 11/1995 | Davis | 135/82 |
| 5,765,583 | A | * | 6/1998 | Gamper | 135/68 |
| 6,085,766 | A | * | 7/2000 | Geary | 135/75 |
| 6,314,977 | B1 | * | 11/2001 | Obitts et al. | 135/68 |
| 6,453,921 | B1 | * | 9/2002 | Rost | 135/67 |
| 6,464,272 | B1 | * | 10/2002 | Michaud | 294/58 |

FOREIGN PATENT DOCUMENTS

| | | | | |
|---|---|---|---|---|
| DE | 4137466 | * | 11/1991 | 135/68 |
| FR | 2680679 | * | 8/1991 | 135/69 |
| JP | 86795 | * | 3/1994 | 135/68 |
| JP | 06-086795 | | 3/1994 | |
| JP | 2000-237253 | | 9/2000 | |

* cited by examiner

*Primary Examiner*—Phi Dieu Tran A
(74) *Attorney, Agent, or Firm*—Burns, Doane, Swecker & Mathis, L.L.P.

(57) ABSTRACT

A crutch 1 has vertical support pipes 2,3, a slider 10 slidably mounted on the support pipes 2,3, a grip 11 mounted on the slider 10, and a slider support system 12 for supporting the slider 10. The slider support system 12 has a movable vertical pipe 31, a fixed vertical pipe 32, a fixing pin 33 provided on the movable vertical pipe 31, and height adjustment holes 34(1) to 34(5) formed in the fixed vertical pipe 32. By changing the height adjustment hole with which the fixing pin 33 is engaged, the height of the grip 11 can be adjusted. No holes must be formed in the vertical support pipes 2,3 for constituting a crutch main body, and height adjustment can be carried out by manipulating only one fixing pin 33.

4 Claims, 3 Drawing Sheets

CRUTCH WITH HEIGHT-ADJUSTABLE GRIP

This application claims priority under 35 U.S.C. §§119 and/or 365 to JP2001-142519 filed in Japan on May 14, 2001; the entire content of which is hereby incorporated by reference.

BACKGROUND OF INVENTION

1. Field of the Invention

This invention relates to a crutch which has a height adjustable grip. More specifically, this invention pertains to a crutch which requires no holes formed in the crutch body frame thereof for adjusting the grip height and is able to adjust the height of the grip simply.

2. Prior Art Description

There have been proposals for a crutch with a height adjustment system in which the user can adjust the grip to a height which will suit his or her physique. For example, JP-A 6-86795 and JP-A 2000-237253 disclose such systems, in which a grip is mounted slidably in the vertical direction along a pair of support pipes for constituting the crutch main body, and a desired grip height can be achieved by inserting pins at the side of the grip into one of holes of the support pipes.

As disclosed in these publications, the grip height adjustment systems of the prior art are basically constituted such that the support pipes of the crutch are formed with a plurality of height adjustment holes. This may degrade the strength of the crutch body, and especially the bending strength thereof. Further, since it is necessary to form the holes in the support pipes, the manufacturing process becomes more complex. In addition, since the grip is fixed on its both sides to the respective support pipes with pins, the both ends of the grip must be removed from and attached to the corresponding support pipes each time when the height of the grip is adjusted. Therefore the height adjustment operation is troublesome and complex.

SUMMARY OF THE INVENTION

A main object of this invention is to provide a crutch having a height adjustable grip, which eliminates the need to form height adjustment holes in the support frame of the crutch main body.

The other object of this invention is to provide a crutch in which the height of the grip can be adjusted simply.

In order to achieve the above and other objects and advantages, according to this invention, there is provided a crutch which comprises:

a pair of vertical support frames;

a grip:

a vertically movable slider for supporting the grip, which is mounted on the vertical support frames so that it is slidable along the vertical support frames; and a slider support means for fixing the vertically movable slider at a prescribed height of the vertical support frames, wherein the slider support means has a fixed vertical pipe fixed at its lower end to the vertical support frames, a movable vertical pipe having an upper end portion on which the vertically movable slider is mounted, a plurality of height adjustment holes at prescribed intervals along an axial direction of the fixed vertical pipe or the movable vertical pipe, and a fixing pin insertable into the height adjustment holes which is constantly pushed horizontally by a spring force, and wherein the lower end portion of the movable vertical pipe is slidably inserted into the fixed vertical pipe from an upper end opening thereof, and wherein the height adjustment holes are formed in an upper end portion of the fixed vertical pipe or a lower end portion of the movable vertical pipe, while the fixing pin is provided on the lower end portion of the movable vertical pipe or the upper end of the fixed vertical pipe.

Since the grip height adjustment holes are formed in the fixed vertical pipe or movable vertical pipe, there is no need to form pin holes in the vertical support frames of the crutch and therefore the strength of the crutch itself is not deteriorated. Furthermore, the manufacturing process of the vertical support frames is made simple.

Moreover, when adjusting the height of the grip, it is only necessary to manipulate only one pin which is provided on the movable vertical pipe or fixed vertical pipe. Therefore, compared to conventional crutches which require removal and reinsertion of the pins on both ends of the grip, adjustment is very simple.

In a preferred embodiment of this invention, the movable vertical pipe is mounted on the vertically movable slider so that it is rotatable on its axis within a prescribed angle range. With this configuration, if one of the vertical pipe having the fixing pin is rotated while adjusting the height of the grip, it is possible to offset the fixing pin away from the holes in the other vertical pipe, thus preventing it from entering the holes. When the movable vertical pipe is rotated back to its original position at a desired height for the required hole, the pin will automatically enter the hole, making grip height adjustment simple and convenient.

In this invention, it is possible to make the grip and the vertically movable slider as a single member.

In addition, it is preferable that the fixing pin has a conical shape and is slightly tapered toward a tip end thereof. The advantage of this is that there is substantially no gap between the pin and the hole, which ensures that the grip fits tightly and does not rattle.

DETAILED DESCRIPTION OF THE PREFERRED EMBODIMENT

With reference to the drawings, there will be explained a crutch having a height adjustable grip according to this invention.

Figure 1:
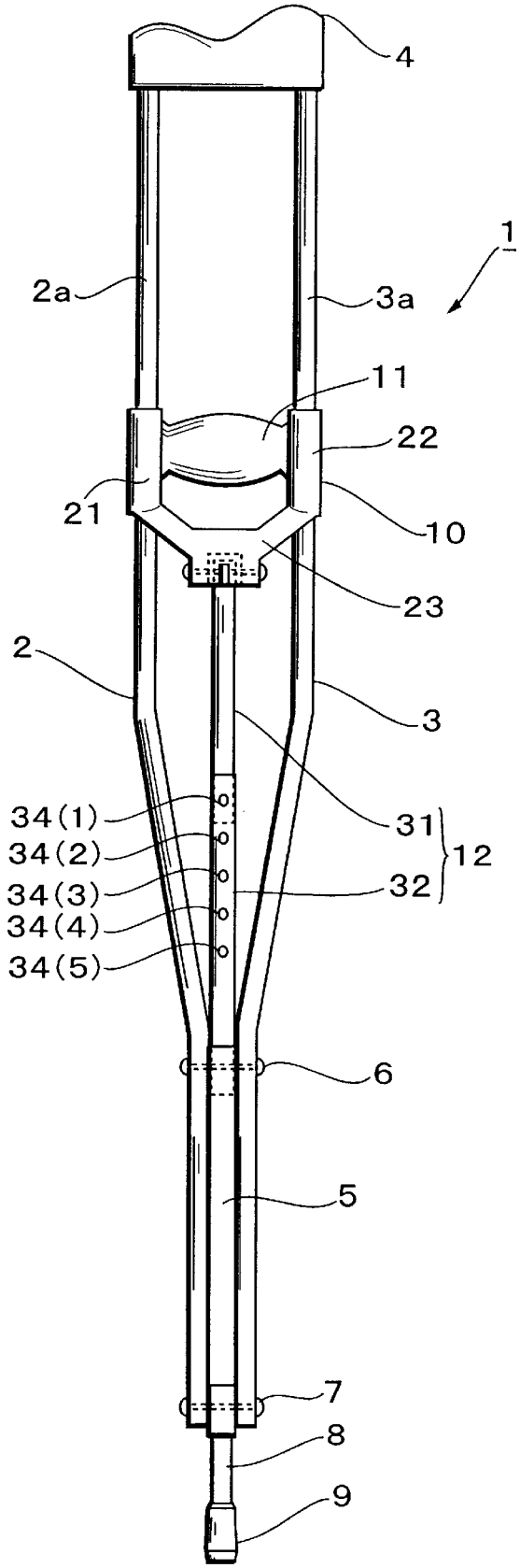
FIG.1 is a side view of a crutch having a height-adjustable grip according to an example of this invention.

FIG. 1 shows an overall structure of the crutch having a height adjustable grip of this example. As shown in the drawing, the crutch 1 has a pair of vertical support pipes 2 and 3 arranged right and left sides thereof, which constitutes a crutch main body. An armpit rest 4 is attached to the upper ends of the vertical support pipes 2,3. The lower end portions of the vertical support pipes 2,3 are fixed together by means of metal brackets 6 and 7 in a manner that a vertical connecting pipe 5 is sandwiched between the pipes 2,3 and the metal brackets 6,7 are located at upper and lower end positions of the connecting pipe 5. A stick 8 extends coaxially and vertically from the lower end of the vertical connecting pipe 5, which has a non-skid rubber stopper 9 attached to its lower end.

The vertical support pipes 2,3 each have upper half portion 2*a* and 3*a* extending in parallel with each other, and a vertically movable slider 10 is arranged between these portions so that it can slide along them. A grip 11 is attached horizontally to the vertically movable slider 10 which is held at a prescribed vertical position along the portions 2*a* and 3*a* by a slider support system 12. The height of the grip 11 can be adjusted by manipulating the slider support system 12.

Figure 2A:
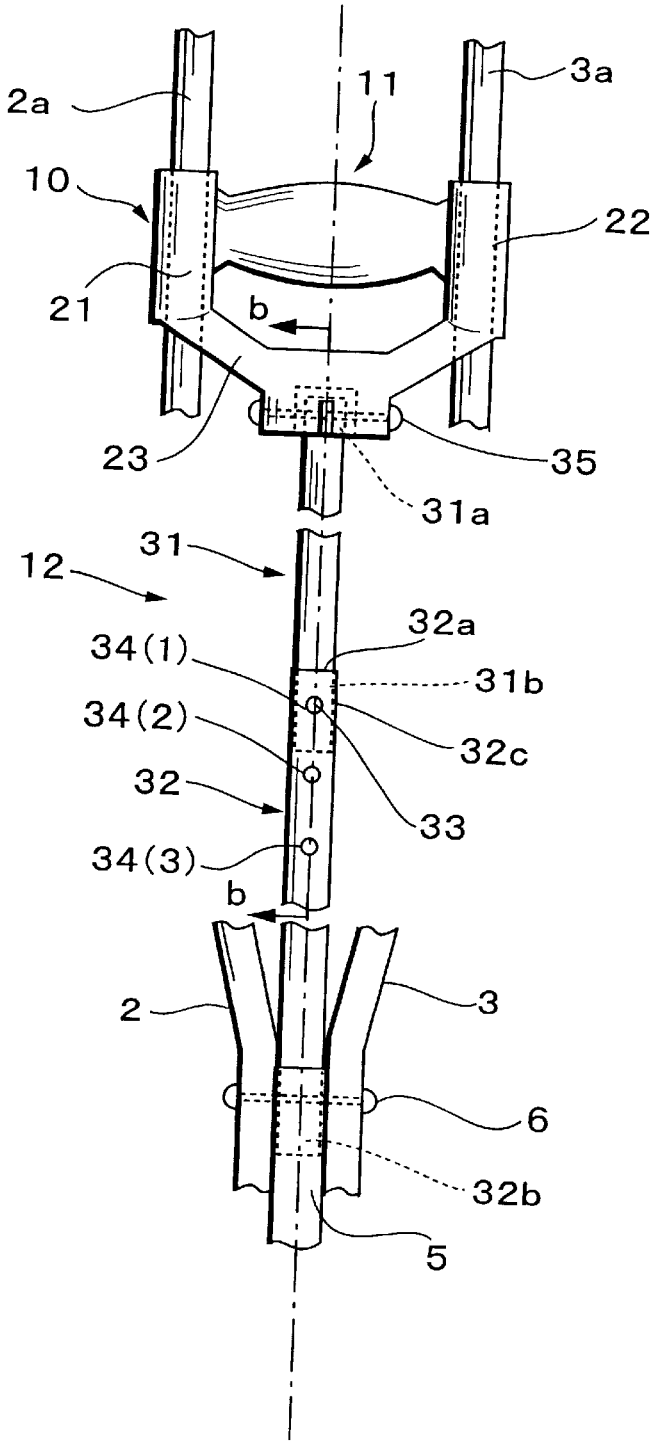
FIGS. 2A and 2B are a partial side view of a slider support system for adjusting the height of the grip of FIG. 1, and a partial sectional view of the slider support system.
Figure 2B:
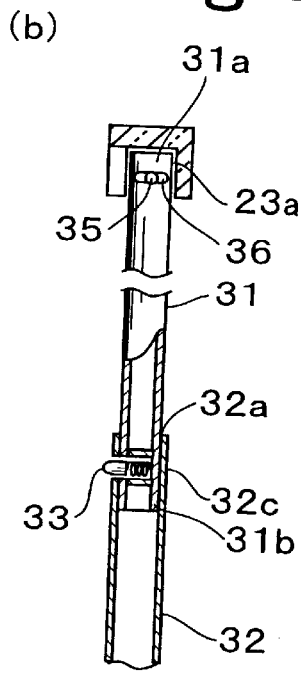

FIGS. 2A and 2B are a partial side view of the crutch 1 showing the slider support system 12 and a partial sectional view thereof, respectively. Referring also to these drawings, the slider 10 and the slider support system 12 will be explained.

The slider 10 is a resin-formed component part, and has right and left tubular portions 21 and 22 for receiving slidably the upper half portions 2*a* and 3*a* of the vertical support pipes 2,3, and a connecting portion 23 for connecting lower end portions of the tubular portions 21,22 with each other. The grip 11 is arranged horizontally across the upper end portions of the tubular portions 21 and 22.

The slider support system 12 for supporting the slider 10 has a movable vertical pipe 31 and a fixed vertical pipe 32, these pipes 31 and 32 being arranged coaxially with each other. The upper-side located movable vertical pipe 31 has an upper end portion 31*a* fixed to the connecting portion 23 of the vertical slider 10, and a lower end portion 31*b* which is slidably inserted into the fixed vertical pipe 32 from the upper end opening 32*a* of the pipe 32. The lower end 32*b* of the fixed vertical pipe 32 is inserted into the vertical connecting pipe 5, and is held in place by a connecting pin 7.

The lower end portion 31*b* of the movable vertical pipe 31, inserted into the fixed vertical pipe 32 is provided with a fixing pin 33 which is applied with a resilient force and is being pushed horizontally and outwardly. The fixed vertical pipe 32 has an upper end portion 32*c* which is formed with a plurality of height adjustment holes, in this example, five holes 34(1) to 34(5) along the axial direction of the pipe 32. These holes are formed such that the fixing pin 33 can project outward through the holes.

The connecting portion 23 of the slider 10 is formed with a slit-formed blind hole 23*a* where the upper end portion 31*a* of the movable vertical pipe 31 is inserted. This portion 31*a* of the movable vertical pipe 31 is joined to the connecting section 23 by a connecting pin 35 which penetrates through these portions 23 and 31*a* horizontally.

The upper side portion 31*a* of the pipe is formed with a pin hole 36 for receiving the connecting pin 35. The pin hole 36 is an elongated one extending in the circumferential direction of the pipe. This elongated pin hole 36 allows the movable vertical pipe 31 to rotate on its axis within a prescribed angle range. As shown in FIGS. 2A and 2B, when the connecting pin 35 provided on the lower end portion 31*b* of the movable vertical pipe 31, is in the middle of the pin hole 36, the pin 33 is located at a position where it is insertable into any one of the height adjustment holes 34(1) to 34(5). If the movable vertical pipe 31 is rotated either to the right or left from the shown position, the pin 33 will be offset away from the height adjustment holes 34(1) to 34(5) in the circumferential direction of the pipe.

In the thus constituted crutch 1 of this example, the height of the grip 11 can be adjusted as follows. For example, the pin 33 is at first being inserted into the highest height adjustment hole 34(1) as shown in FIG. 2A. In this condition, the pin 33 is pressed with a finger or the like to eject from the height adjustment hole 34 (1), which allows the movable vertical pipe 31 to move freely along the vertical direction. As a result, the slider 10, which is connected on the upper end of the movable vertical pipe 31 can be slid vertically along the vertical support pipes 2,3, and so the height of the grip 11 mounted on the slider 10 can be adjusted.

If the grip 11 is pushed down so that its position is adjusted to that of one-step lower side, the slider 10 supporting the grip 11 slides down along the vertical support pipes 2,3, together with the movable vertical pipe 31. Thus, the lower end portion 31*b* of the pipe 31*b* becomes inserted more deeply in the fixed vertical pipe 32. When the pin 33 in the retracted condition reaches the position of the next height adjustment hole 34(2), it is pushed out by the spring force to project outside through the hole 34(2), namely it becomes engaged in the hole 34(2). As a result, the grip 11 is fixed at a height defined by the second adjustment hole 34(2), the height being one-step lower than that defined by the first adjustment hole 34(1).

On the other hand, in order to move the grip 11 from the highest adjustment hold 34(1) to the two-step lower position defined by the third hole 34(3), the movable vertical pipe 31 should be rotated so as to offset the pin 33 away from the height adjustment holes 34(1)–34(5) and then moved down. When done this way, the movable vertical pipe 31 can be moved down as far as the position of the third hole 34(3) without the pin 33 getting caught in the second hole 34(2). When the position corresponding to the third hole 34(3) is reached, the movable vertical pipe 31 should be rotated back to its original position and the pin 33 becomes caught in the hole. Thus the grip 11 is fixed at the desired height.

According to the crutch 1 of this example, there is no need to form a number of height adjustment holes in the vertical support pipes 2,3 constituting the main body of the crutch. Thus the strength of the crutch, especially the bending strength thereof, is not deteriorated. Further, since there is no need to form holes in the vertical support pipes, the manufacturing process becomes simple.

Furthermore, it is only necessary to manipulate the single pin 33 when adjusting the height of the grip. Thus, compared to conventional crutches in which it is necessary to remove and reinsert two pins on the respective ends of the grip, adjustment is simple.

Although the slider 10 and the grip 11 are separate component parts in this example, these can be made as a single member. Also, the movable vertical pipe 31 is rotatable on its axis in this example, but rotation of the pipe 31 can be eliminated. Furthermore, in this example the pin 33 is provided on the side of the movable vertical pipe 31 and the height adjustment holes 34(1)–34(5) are formed in the fixed vertical pipe 32, but the opposite constitution, in which the height adjustment holes are formed in the movable vertical pipe, and the pin is arranged on the fixed vertical pipe 32, can also be adopted.

Next, the pin 33 will be explained in detail. A typical fixing pin has a shape of column and a hemi-spherical head. When the typical fixing pin is employed for the crutch 1 of this example, the outside diameter of the pin must be set about 0.1 mm smaller than the pin hole. Because of this gap, when the pin is inserted in the hole, a slight loose is formed between the pin and hole. If this gap were not there, it would be difficult to insert the pin into the hole.

Figure 3:
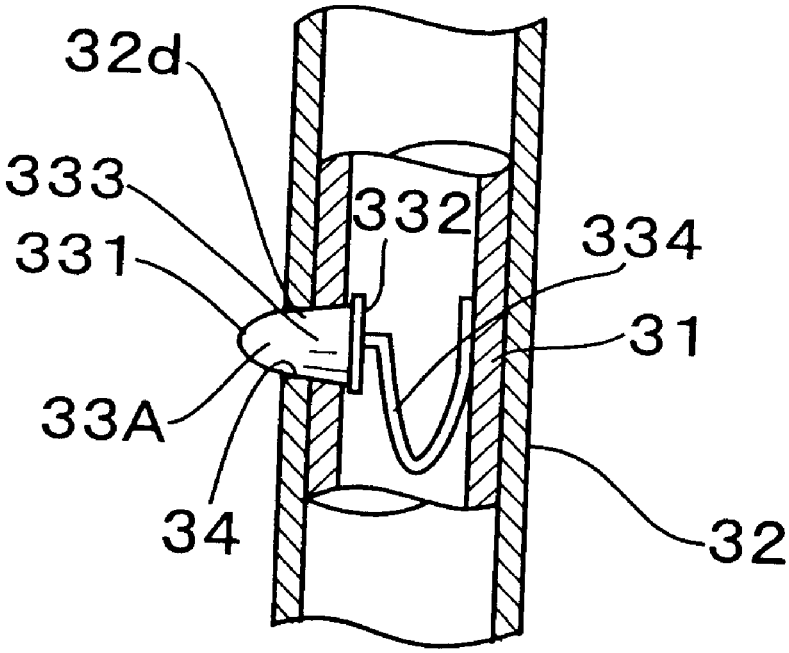
FIG. 3 is an explanatory view showing a desired example of a fixing pin of FIG. 1.

In order to avoid the rattling when the pin is fixed in the pin hole, in a desired example, a pin of the following shape is employed. As shown in FIG. 3, the pin 33A has a head 331 having a hemi-spherical shape, a base rim 332 and a body section 333 between the head 331 and the base rim 332. The body section 333 has a conical shape and is tapered slightly toward the head 331. The pin 33A is constantly pushed through the pin hole 32*d* in a horizontal direction, by the force of a V-shaped spring 334 which is attached to the center of the base of the pin. When this pin is inserted into the pin hole 34 of the pipe 32, because the body section 333 is tapered, it is possible to realize a fixing condition without rattling by setting the diameter of the pin hole 34 appropriately.

As explained above, according to the crutch having the height adjustable grip of this invention, the grip is attached to a slider which is slidable along the vertical support frames. The slider support system is constituted by a fixed vertical pipe and a movable vertical pipe inserted into it. The slider is mounted on the upper end of the movable vertical pipe, and the height of the grip is adjusted by controlling the amount of insertion of the movable vertical pipe inserted into the fixed vertical pipe.

Therefore, this invention eliminates the need to form grip height adjustment holes in the vertical support frame constituting the crutch main body. Thus, the strength of the crutch, and especially the bending strength thereof, is not deteriorated, and the manufacturing process is made simple.

Since the height of the grip can be adjusted by manipulating just one pin, adjustment is simple compared to conventional crutches in which it is necessary to remove and reinsert a plurality of pins at both ends of the grip.

When a conical pin is used for setting the height of the grip, the problem of rattling caused by the use of cylindrical pins can be solved.

What is claimed is:

1. A crutch comprising:

a pair of vertical support frames;

a vertical connecting pipe located between and fixed to lower portion of the vertical support frames;

a stick extending coaxially and vertically from a lower end of the fixed vertical connecting pipe;

a grip;

a vertically movable slider for supporting the grip, which is mounted on the vertical support frames so that it is slidable along the vertical support frames; and a slider support means for fixing the vertically movable slider at a prescribed height of the vertical support frames; wherein the slider support means has a fixed vertical pipe fixed at its lower end to the vertical support frames via the fixed vertical connecting pipe, a movable vertical pipe having an upper end portion on which the vertically movable slider is mounted, a plurality of height adjustment holes at prescribed intervals along an axial direction of the fixed vertical pipe or the movable vertical pipe, and a fixing pin insertable into the height adjustment holes which is constantly pressed by a spring force, wherein the lower end portion of the movable vertical pipe is slidably inserted into the fixed vertical pipe from an upper end opening thereof, and wherein the height adjustment holes are formed in an upper end portion of the fixed vertical pipe or a lower end portion of the movable vertical pipe, while the fixing pin is provided on the lower end portion of the movable vertical pipe or the upper end portion of the fixed vertical pipe.

2. A crutch according to claim 1, wherein the movable vertical pipe is mounted on the vertically movable slider so that it is rotatable on its axis within a prescribed angle range.

3. A crutch according to claim 1, wherein the grip and the vertically movable slider are made as a single member.

4. A crutch according to claim 1, wherein the fixing pin has a conical shape and is slightly tapered toward a tip end thereof.

* * * * *